US006336283B1

(12) United States Patent
Ortiz

(10) Patent No.: US 6,336,283 B1
(45) Date of Patent: Jan. 8, 2002

(54) RIFLE SIGHTING APPARATUS

(76) Inventor: Julio A. Ortiz, 7735 Crooked Brook, San Antonio, TX (US) 78250

( * ) Notice: Subject to any disclaimer, the term of this patent is extended or adjusted under 35 U.S.C. 154(b) by 0 days.

(21) Appl. No.: 09/653,260

(22) Filed: Aug. 31, 2000

(51) Int. Cl.[7] ..... F41A 19/00
(52) U.S. Cl. ..... 42/69.01; 89/27.3
(58) Field of Search ..... 89/27.3, 27.11; 42/120, 111, 106, 69.01, 70.06, 90

(56) References Cited

U.S. PATENT DOCUMENTS

| | | | | | |
|---|---|---|---|---|---|
| 2,586,317 | A | | 2/1952 | Fay | |
| 2,841,908 | A | * | 7/1958 | Bourquin | 42/69 |
| D196,842 | S | | 11/1963 | Schaefer | |
| 3,422,560 | A | | 1/1969 | Foote et al. | 42/70 |
| 4,030,221 | A | | 6/1977 | Doobenen et al. | |
| 4,276,808 | A | | 7/1981 | York | 89/136 |
| 4,509,281 | A | | 4/1985 | Dreiling et al. | |
| 4,532,852 | A | | 8/1985 | Hance et al. | 89/136 |
| 4,787,288 | A | | 11/1988 | Miller | 89/136 |
| 4,803,910 | A | | 2/1989 | Troncoso | 89/27.3 |
| 4,995,180 | A | | 2/1991 | Tucker et al. | 42/70.07 |
| 5,054,222 | A | | 10/1991 | Hardy | 42/70.07 |
| 5,074,190 | A | | 12/1991 | Troncoso | 89/136 |
| 5,392,551 | A | | 2/1995 | Simpson | 42/70.07 |
| 5,450,684 | A | | 9/1995 | Harris | 42/70.07 |
| D375,342 | S | | 11/1996 | Collins | D22/108 |
| D393,305 | S | | 4/1998 | Misner et al. | D22/108 |
| D394,297 | S | | 5/1998 | Knuth | D22/108 |
| 5,778,586 | A | | 7/1998 | Carlson | 42/70.07 |
| 5,806,225 | A | | 9/1998 | Gardner et al. | 42/69.02 |
| 6,012,374 | A | | 1/2000 | Brandl et al. | 89/1.41 |
| 6,164,002 | A | * | 12/2000 | Troncoso | 42/69.01 |
| 6,223,644 | B1 | * | 5/2001 | Troncoso | 89/136 |

* cited by examiner

*Primary Examiner*—Michael J. Carone
*Assistant Examiner*—Gabriel S Sukman
(74) *Attorney, Agent, or Firm*—Cox & Smith Incorporated

(57) ABSTRACT

This disclosure is directed to a trigger operating mechanism for sighting in rifles which could be utilized by either a right-handed or left-handed user. A preferred trigger operating mechanism comprises a pair of plates which are clampable against opposed sides of the trigger guard of the rifle. A shaft traverses one of the plates, and the inner end of the shaft mounts a trigger displacing cam adjacent the trigger between the pair of plates. A manually operable knob is secured to the outer end of the shaft. Rotation of the knob will effect a gradual rearward displacement of the trigger to its firing position, thus eliminating any tendency of the user of the rifle to jerk the trigger and disturb the line of sight for the particular firing. Alternative embodiments may include a lock such that a key is required to operate the mechanism, a single mounting plate rather than a pair of mounting plates, or a snap-in mounting body that mates with the interior surface of the trigger guard.

19 Claims, 7 Drawing Sheets

RIFLE SIGHTING APPARATUS

BACKGROUND OF THE INVENTION

1. Field of the Invention

The invention relates to an apparatus for effecting the sighting of a rifle to accurately align the sights provided on the rifle with the normal eye position of the user when firing the rifle, and particularly to a mechanism for eliminating the effects of trigger jerking on the accuracy of the sighting.

2. Description of the Related Art

A necessary step in the utilization of any new rifle by its purchaser is to adjust the sights of the rifle, particularly the rear sights thereof, to permit the accurate firing of the rifle by its new user. As is well known, the physical contour ii and dimensional location of the eyes of individuals vary substantially, so it is quite important that the rifle be sighted in by the particular user. Resighting is also required if any change in ammunition is effected.

Such sighting is generally accomplished with the barrel of the rifle resting on a support, such as a rail fence, and the stock of the rifle positioned against a fixed support adjacent the shoulder of the user in substantially the same position that the user would expect to assume during all subsequent firing of the rifle. The precaution of resting the barrel and stock of the rifle on fixed supports does not, however, eliminate the adverse effects of an improper trigger squeeze or jerking of the trigger. This is the most common fault encountered not only in the firing of the rifle, but also in the sighting of it, and a jerking of the trigger, however slight, will disturb the accuracy of the sighting. There is a need, therefore, for an apparatus which will permit the sighting of the rifle to be accomplished without utilization of the user's finger to depress the trigger.

SUMMARY OF THE INVENTION

In accordance with this invention, a trigger operating apparatus is provided which is clampable on the rifle by two plates respectively positioned on opposite sides of the trigger guard commonly found on every rifle. In one embodiment of the present invention, a spacer block is secured to one of the plates, disposed within the trigger guard and abutting the forward portion of the trigger guard. The spacer block receives one or more clamping bolts which traverse the other plate. A shaft is rotatably mounted in one of the plates and has an inner end portion lying within the trigger guard and adjacent to the trigger in its unfired position. The outer end of the shaft projects exteriorly of the mounting plate and mounts a manually graspable knob. On the inwardly projecting portion of the shaft, a cam is formed which, by rotation of the shaft, engages the trigger and depresses the trigger to its firing position. Preferably, the shaft is slowly rotated by the user of the rifle and the trigger is cammed rearwardly with a substantially continuous motion. Even if the shaft is rotated at a higher than recommended speed, no jerking of the trigger will result because the cam action moves the trigger smoothly from its inactive position to its firing position.

In another embodiment of the present invention, a trigger operating apparatus is provided which is clampable on the rifle by two plates designed for use by either a right-handed or left-handed user. Those plates are respectively positioned on opposite sides of the trigger guard. The one plate has a recessed area on its periphery to engage the interior surfaces of the trigger guard on either the right or left side. The two mounting plates are secured together by one or more clamping bolts. A cam mounting shaft traverses the mounting plates and extends outwardly from one of the mounting plates for mounting of a manually graspable knob. A rotary cam is secured to the shaft for co-rotation in a selected direction, which rotation is opposed and limited by a helical spring mounted between the cam and the one mounting plate. Preferably, the right-handed user will slowly rotate, either clockwise or counter-clockwise, depending on the cam design, the manual knob which is on the right side of the trigger guard, thereby camming the trigger rearwardly with a substantially continuous motion. For left-handed firing, the mounting plates are reversed in position and the manually operable knob is on the left side of the trigger guard. The cam operation, however, is the same as in the right-handed configuration. Thus, accurate sighting for either a right-handed or left-handed user of the rifle may be accomplished by the elimination of trigger jerking.

In yet another embodiment of the present invention, a trigger operating apparatus with a lock and key feature is secured on the rifle by two clampable plates respectively positioned on opposite sides of the trigger guard. A shaft is rotatably mounted in one of the clampable plates, and an inner end portion of the shaft lies within the trigger guard and adjacent to the trigger in its unfired position. The outer end of the shaft projects exteriorly of the mounting plate and passes through a spring keeper cylinder and is positioned inside a key housing. A bolt aligns the key housing with the spring keeper cylinder. The key housing, which is fitted with the shaft and spring keeper cylinder, is secured to the mounting plate with housing retainer screws. Preferably, the shaft is slowly rotated and the trigger is cammed rearwardly by inserting a key into the key housing and turning with substantially continuous motion. Even if the shaft is rotated at a higher than recommended speed, no jerking of the trigger will result since the cam action moves the trigger smoothly from its inactive position to its firing position.

Still another embodiment of this invention comprises a mounting plate with one or more plug portions extending from the mounting plate. A shaft is rotatably mounted in the mounting plate and a cam is attached to the shaft for engagement with the trigger as in the above-described embodiments, and the apparatus is secured to the trigger guard by pressing the plug portions into the trigger guard. Alternatively, a mounting plate having one or more clamping plates extending therefrom may be used to mount the apparatus to the trigger guard.

Further objects and advantages of the present invention will be readily apparent to those skilled in the art from the following detailed description taken in conjunction with the annexed sheets of drawings, which illustrate several preferred embodiments of the invention.

DETAILED DESCRIPTION OF PREFERRED EMBODIMENTS

Figure 1:
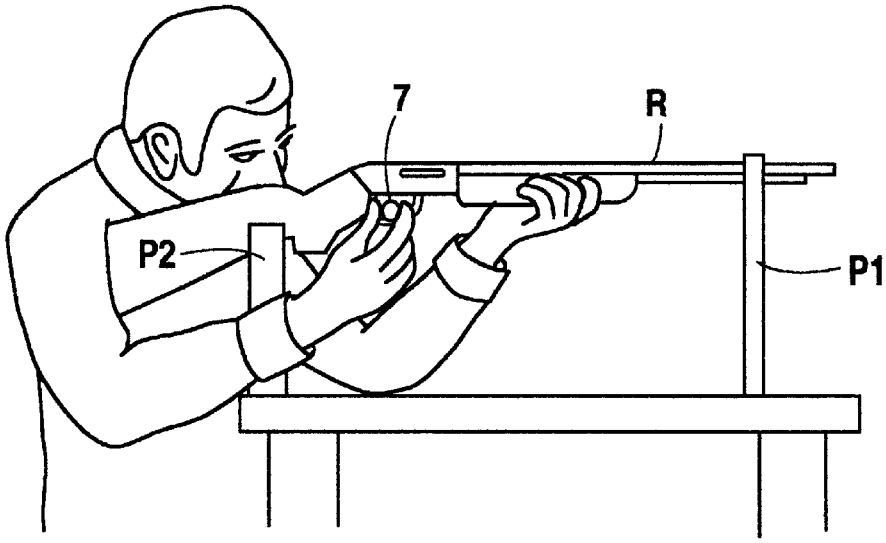
FIG. 1 is a schematic perspective view illustrating the sighting of a rifle incorporating this invention.

Referring to FIG 1, it is customary to sight in a new by positioning the rifle R against the shoulder of the user and supporting the barrel of the rifle on an appropriate support post P1. The stock may also be supported by a post P2. In accordance with this invention, the trigger of the rifle is actuated by turning knob 7 which drives an actuating element for the trigger.

Figure 2:
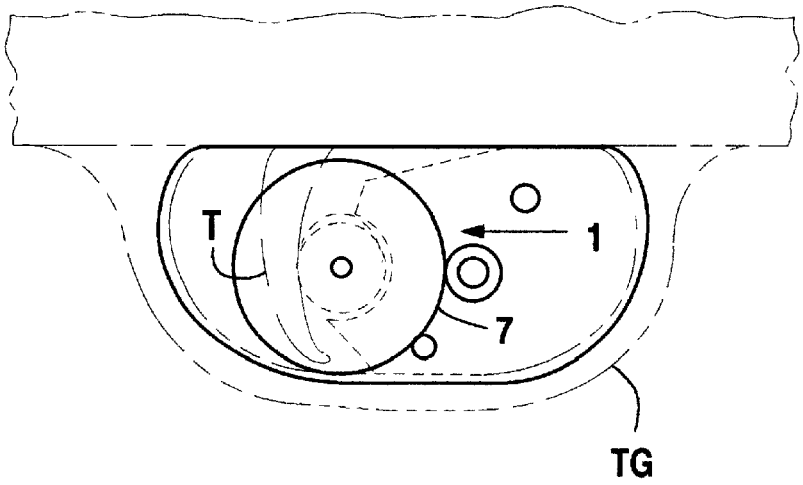
FIG. 2 is an enlarged scale side elevational view of the trigger guard portion of the rifle of FIG. 1 with a trigger actuating mechanism embodying this invention assembled thereto.
Figure 3:
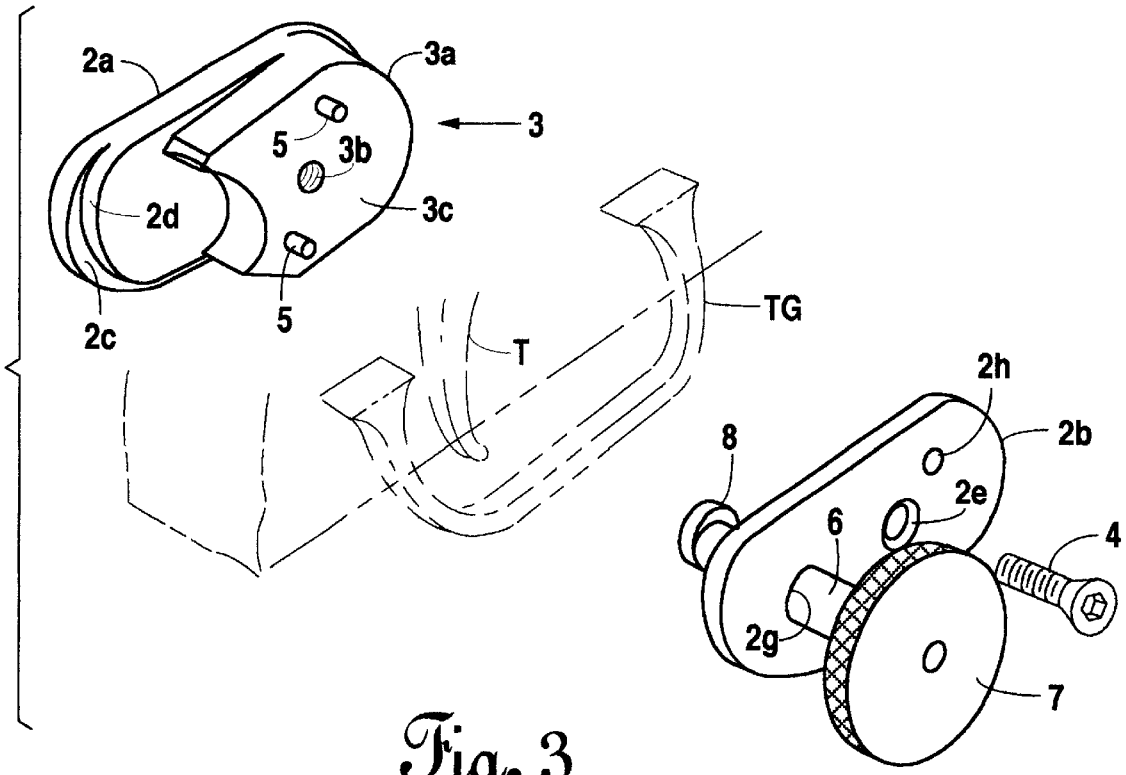
FIG. 3 is an exploded perspective view of FIG. 2.
Figure 4:
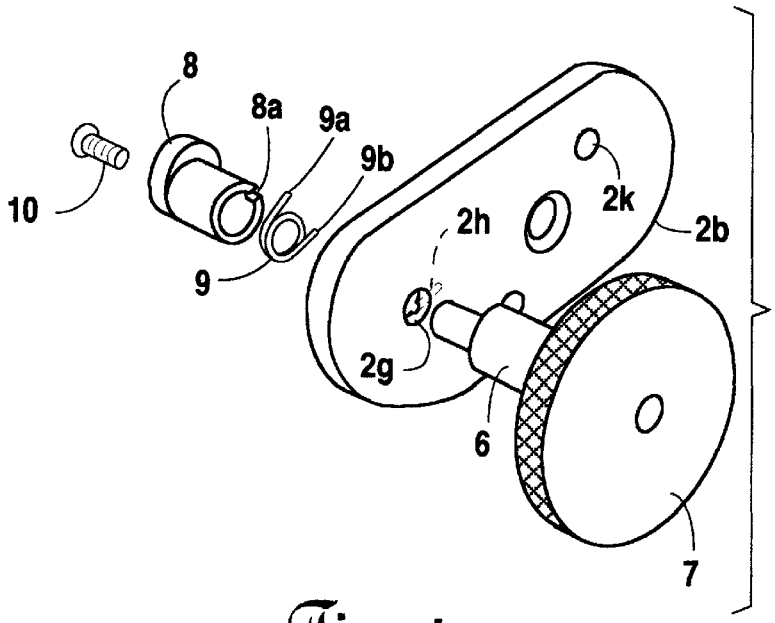
FIG. 4 is an exploded perspective view illustrating the mounting of the spring which opposes and limits the turning movement of the operating knob.

Referring now to FIGS. 2–4 of the drawings, the trigger actuating mechanism 1 embodying this invention for a right-handed shooter comprises a generally oval shaped shaft mounting plate 2*b* and an opposing plate 2*a* which are adapted to engage the sides of the trigger guard TG which normally surrounds the trigger T. Preferably, a spacer block 3 is formed on one of the plates, preferably plate 2*a* for right-handed users, and is machined to a thickness such that when plate 2*b* is brought into engagement or near engagement with spacer block 3, the two plates 2*a* and 2*b* will snugly engage the sides of trigger guard TG. Plate 2*a* preferably has a portion of its periphery cut away to define a shoulder 2*c* which engages the side wall of trigger guard TG and also defines a wall portion 2*d* which engages the inner surface of the rear portion of trigger guard TG. Spacer block 3 has an end surface 3*a* engagable with the inner surface of the front portion of trigger guard TG. Thus, plate 2*a* is secured against displacement relative to trigger guard TG. Plates 2*a* and 2*b* are snugly secured together by one or more fasteners such as screws or bolts 4. Preferably, bolt 4 traverses a hole 2*e* provided in plate 2*b* and engages a tapped hole 3*b* in spacer block 3. Alternatively, spacer block 3 could be eliminated and plates 2*a* and 2*b* could be secured to trigger guard TG by two bolts. If it is desired to use only a single bolt, then a pair of dowel pins 5 are preferably press fitted into face 3*c* of spacer block 3 and cooperate with holes 2*k* provided in plate 2*b*, thereby preventing relative angular displacement of plates 2*a* and 2*b*.

A trigger actuating shaft 6 is rotatably mounted within a hole 2*g* provided in plate 2*b*. The outer end portion of shaft 6 may be enlarged to form a manually operable knob 7. Alternatively, knob 7 may be separately formed and then press fitted onto the outer end portion of shaft 6. The inwardly projecting end of actuating shaft 6 mounts a cam 8 with screw 10 which screws into a tapped hole (not shown) in the inwardly projecting end of shaft 6. Cam 8 is positioned closely adjacent to trigger T in its inactive or nonfiring position when plates 2*a* and 2*b* are clamped together around trigger guard TG by bolt 4. Cam 8 is designed to effect a rearward displacement of trigger T by rotation of knob 7. Whether this rotation is clockwise or counter-clockwise depends solely on the preference of the user of the trigger operating mechanism. In either event, rotation of knob 7 effects rotation of cam 8 and in turn produces a gradual rearward movement of trigger T to its firing position. This arrangement substantially eliminates jerking of trigger T because any speed of manual rotation of knob 7 still results in a smooth rearward displacement of trigger T.

Cam 8 is preferably hollow to provide a mounting notch 8*a* for a torsion spring 9. One end 9*a* of spring 9 is anchored to notch 8*a* of cam 8 while the other end 9*b* engages in a slot 2*h* formed on the inner side of plate 2*b* immediately adjacent hole 2*g*. Slot 2*h* is shown only by dotted lines in FIG. 4. From its neutral position, spring 9 permits only a limited rotational movement of knob 7, shaft 6, and cam 8 in the direction required to produce movement of trigger T. When knob 7 is rotated in the selected direction to produce firing of trigger T, such movement is resisted by spring 9, resulting in a winding up of spring 9 on shaft 6 to a collapsed or limiting position after cam 8 reaches the trigger firing position. Spring 9 thus serves as a resilient rotation limiter. This function of spring 9 is very important because it insures that knob 7 must be released to return to its neutral position before the trigger can again be actuated. In other words, the actuation of knob 7 only results in successive single shot firings of the rifle R. Since many modern hunting rifles are of the semi-automatic type, the trigger actuating mechanism embodying this invention is primarily useful in the initial sighting of the rifle or in the sighting of the rifle when changes in ammunition are desired by the user. It is not contemplated that this invention will be utilized to fire the rifle in target competition or in game hunting because the rotation of the knob 7, when the front end of the rifle R is not firmly supported, will produce an undesirable movement of the rifle R during the trigger actuating process. In the sighting operation, the forward end of the rifle R is firmly supported and held against the support posts P1 and P2 by the user, hence the rotational movement of the knob 7 does not produce any displacement of the barrel of the rifle R from the desired line of sight.

Figure 5:
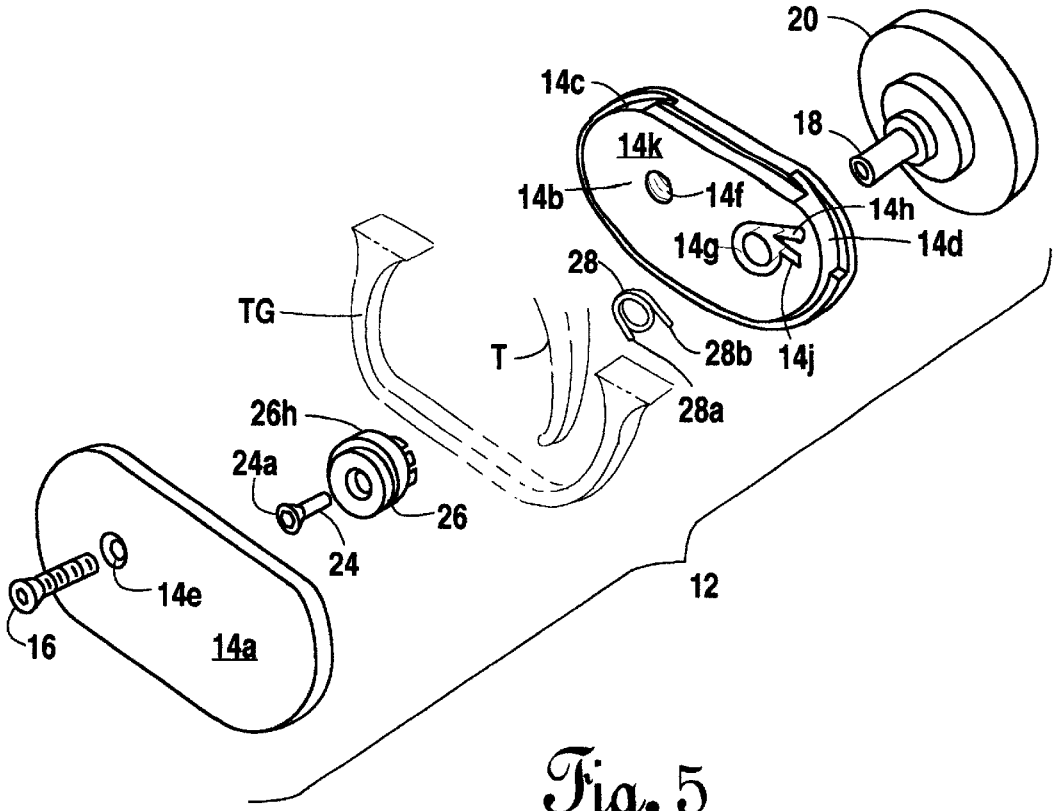
FIG. 5 is an enlarged scale, exploded perspective view of the trigger guard portion of the rifle of FIG. 1 with an alternative trigger actuating mechanism embodiment assembled thereto for right-handed operation.
Figure 6:
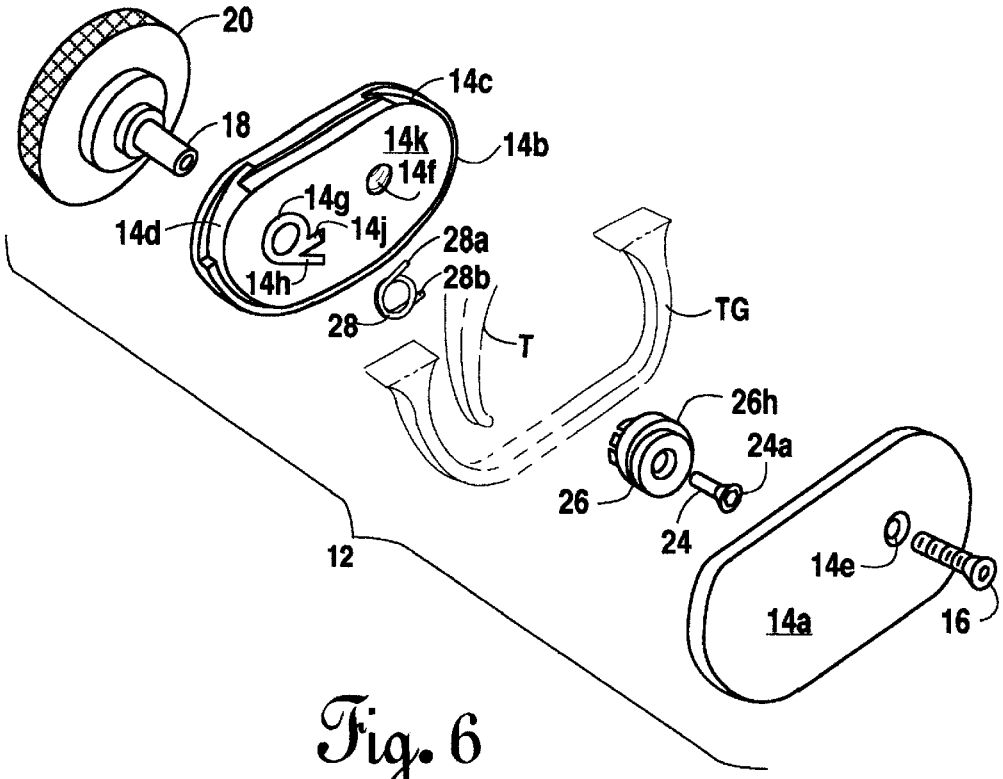
FIG. 6 is an enlarged scale, exploded perspective view of the trigger guard portion of the rifle of FIG. 1 with an alternative trigger actuating mechanism embodiment assembled thereto for left-handed operation.

Referring now to FIGS. 5–9 of the drawings, there is shown an alternate trigger actuating mechanism 12 which may be utilized for right-handed or left-handed firing. This embodiment of the invention comprises a generally oval shaped mounting plate 14*b* and an opposing plate 14*a* which are adapted to engage the sides of the trigger guard TG which normally surrounds the trigger T. Preferably, plates 14*a* and 14*b* are machined to a configuration so that the two plates will snugly engage the opposite sides of the trigger guard TG. Mounting plate 14*b* preferably has a portion of its periphery cut away to define a shoulder 14*c* which engages the inner surface of the front portion of the trigger guard TG and also defines a wall portion 14*d* which engages the inner surface of the rear portion of trigger guard TG. Thus, mounting plate 14*b* is secured against displacement relative to the trigger guard TG. The two plates 14*a* and 14*b* are snugly secured together by one or more fasteners, such as screw or bolt 16. Preferably, bolt 16 traverses a hole 14*e* provided in plate 14*a* and engages a tapped hole 14*f* in plate 14*b*. In FIG. 5, plates 14*a* and 14*b* are assembled to trigger guard TG for right-handed firing. In FIG. 6, plates 14*a* and

14*b* are assembled to trigger guard TG for left-handed firing. In either position, trigger actuating shaft 18 is rotatably mounted within a hole 14g provided in mounting plate 14*b*. The outer end portion of shaft 18 may be enlarged to form a manually operable knob 20. Alternatively, knob 20 may be separately formed and then press fitted onto the outer end portion of shaft 18. The inner end of shaft 18 may be internally tapped to receive threaded screw 24.

Figure 7:
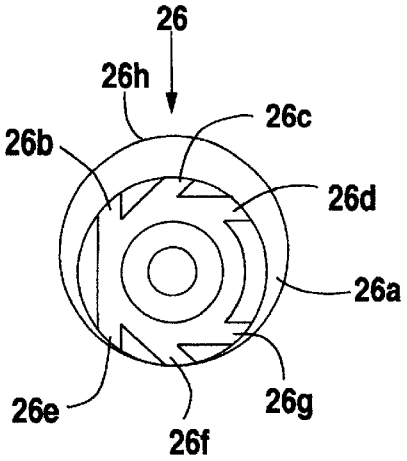
FIG. 7 is an enlarged scale front elevational view of the cam utilized in FIGS. 5 and 6.
Figure 8:
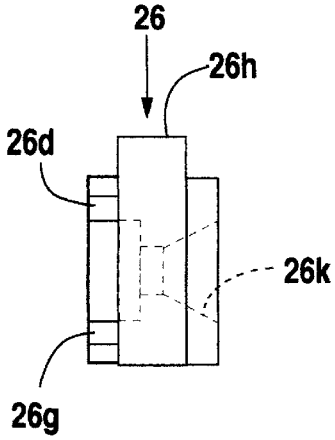
FIG. 8 is a side elevational view of the cam of FIG. 7.
Figure 9:
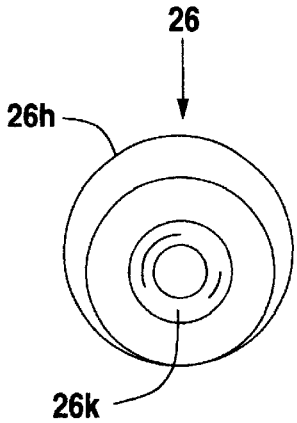
FIG. 9 is rear elevational view of the cam of FIG. 7.

The inwardly projecting end of shaft 18 mounts a cam 26 which is co-rotatably secured thereto by screw 24. Cam 26 is positioned closely adjacent to the trigger T in its inactive or nonfiring (neutral) position when plates 14*a* and 14*b* are secured together around trigger guard TG by bolt 16. Cam 26 has a cam surface 26*h* designed to effect a rearward displacement of the trigger T by rotation of shaft 18 with knob 20. Whether this rotation is clockwise or counter-clockwise depends solely on the preference of the user of the trigger operating mechanism and appropriate design of cam surface 26*h*. In either event, rotation of knob 20 in the selected direction effects rotation of cam 26 and in turn produces a gradual rearward movement of the trigger T to its firing position. Again, this arrangement substantially eliminates jerking of the trigger T because any speed of manual rotation of knob 20 still results in a smooth rearward displacement of trigger T. A helical spring 28 is mounted on shaft 18 between cam 26 and the inner surface 14*k* of mounting plate 14*b*. Spring 28 opposes and limits rotary movement of cam 26. Referring to FIGS. 7–9, one end face 26*a* of cam 26 (FIG. 7) has a hollow portion and angularly spaced generally tangential slots 26*b*–26*g* for receiving one end 28*a* of spring 28. The other end face of cam 26 has a recess 26*k* to receive the head 24*a* of screw 24. For right-handed shooters, one of three slots 26*b*, 26*c*, or 26*d* may be selectively utilized to receive end 28*a* of spring 28 to oppose clockwise rotation of cam 26 with different torsional resistances. For left-handed shooters, one of slots 26*e*, 26*f*, or 26*g* selectively receives end 28*a* of spring 28. The other end 28*b* of spring 28 selectively engages one of slots 14*h* or 14*j* formed on the inner face 14*k* of plate 14*b* immediately adjacent to hole 14*g*. The selection of different slots to engage the ends of spring 28 permits the selection of a desired positioning of cam 26 relative to the trigger T and a desired resistance to rotation of knob 20. In its normal inactive (neutral) position, the spring 28 permits only a limited rotational movement of knob 20 in the direction required to produce firing of the trigger T. When knob 20 is rotated in the direction to produce firing of trigger T, such movement is resisted by spring 28, resulting in a winding up of spring 28 until cam 26 reaches the trigger firing position. Spring 28 thus serves as a resilient rotation limiter. Once again, this function of spring 28 is very important in either the right-handed or left-handed assembly of the present invention because knob 20 must be released to return to its neutral position before the trigger can again be actuated. Thus, the actuation of knob 20 only results in successive single shot firings of the rifle R.

Figure 10:
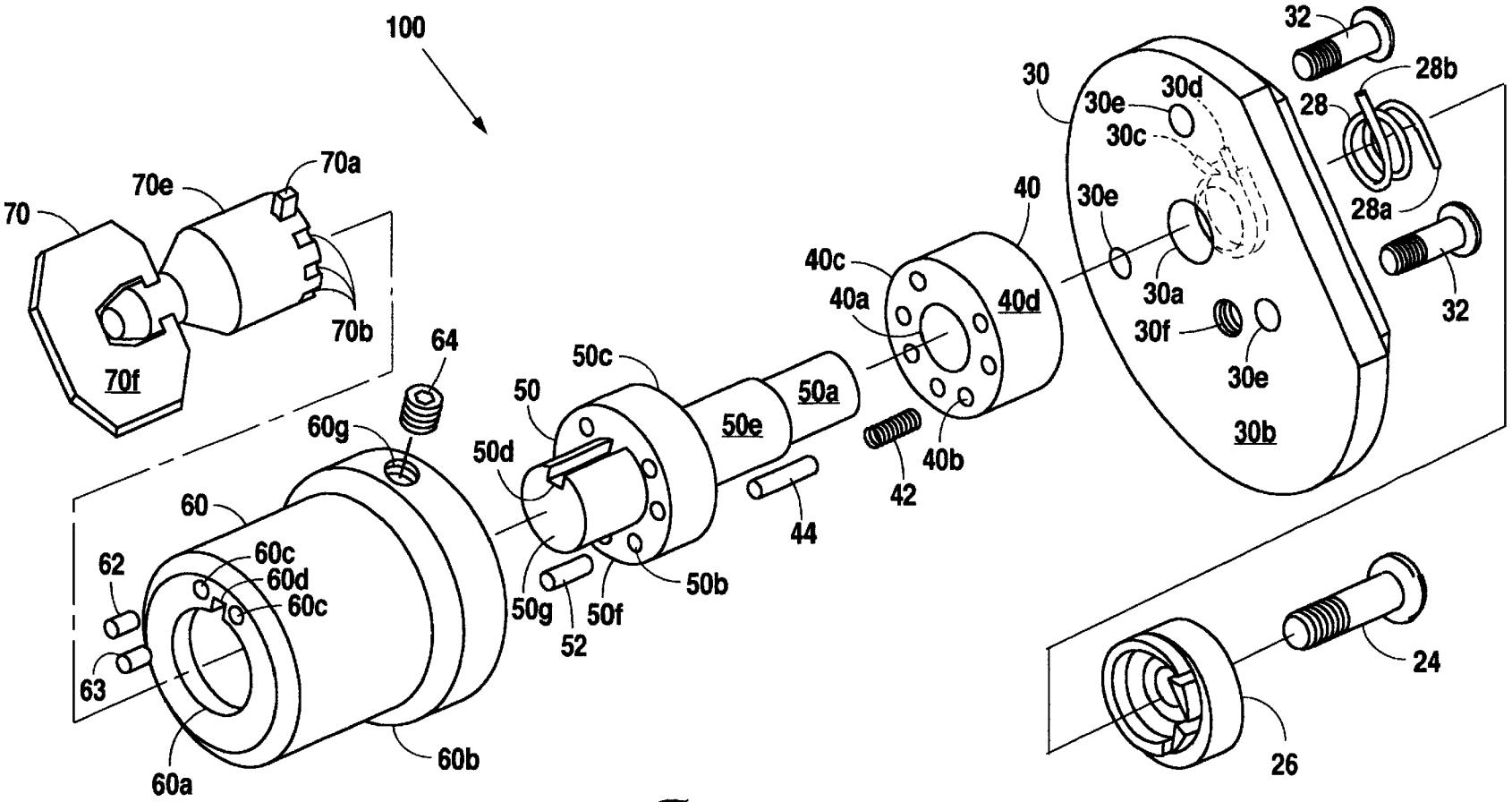
FIG. 10 is an exploded perspective view illustrating another alternative embodiment of the present invention having a lock and key apparatus.

Referring to FIG. 10, another alternative embodiment 100 of the present invention contains a lock and key apparatus for improved safety and security. This alternative embodiment 100 contains a mounting plate 30 that is similar to mounting plate 14*b* of FIGS. 5 and 6, except that mounting plate 30 has one or more holes 30*e* for attaching a lock housing 60, as further described below. Mounting plate 30, which cooperates with an opposing plate 14*a* (not shown in FIG. 10) as in FIGS. 5 and 6, has a tapped hole 30*f* for receiving bolt 16 (not shown in FIG. 10) as in FIGS. 5 and 6. Mounting plate 30 also has slots 30*c* and 30*d* in the surface opposite surface 30*b* similar to slots 14*h* and 14*j* as in FIGS. 5 and 6 for receiving end 28*b* of spring 28. End 28*a* of spring 28 engages cam 26 as previously described in connection with FIGS. 5 and 6. As shown in FIG. 10, the lock mechanism of this embodiment comprises a lock shaft 50 having a cylindrical portion 50*a* on one end for insertion through hole 40*a* of a spring keeper cylinder 40 and through hole 30*a* of mounting plate 30. Spring keeper cylinder 40 has a plurality of blind holes 40*b* extending partially into cylinder 40 from face 40*c*. Blind holes 40*b*, which are preferably of uniform depth, receive a matching plurality of pin springs 42 followed by a matching plurality of locking pins 44. When assembled, pin springs 42 are recessed in blind holes 40*b*, and locking pins 44 slightly protrude from face 40*c*. Lock shaft 50 has an enlarged portion with a matching plurality of through holes 50*b* for receiving a matching plurality of push pins 52. Unlike locking pins 44, which are preferably of equal length, push pins 52 are of varying lengths for cooperation with recesses 70b of key 70 as will be described below. For the sake of clarity, only one each of pin springs 42, locking pins 44, and push pins 52 are shown in FIG. 10. End 50*g* of lock shaft 50 has a groove 50*d* for cooperation with key 70 as will be described below. A generally cylindrical lock housing 60 fits over lock shaft 50 and spring keeper cylinder 40. Lock housing 60 has a tapped hole 60*g* for receiving a set screw 64. The outer end of lock housing 60 has a hole 60*a* with a slot 60*d* for receiving key 70. Holes 60*c* in lock housing GO receive stop pins 62 and 63 which limit rotation of key 70 as described below.

Figure 12:
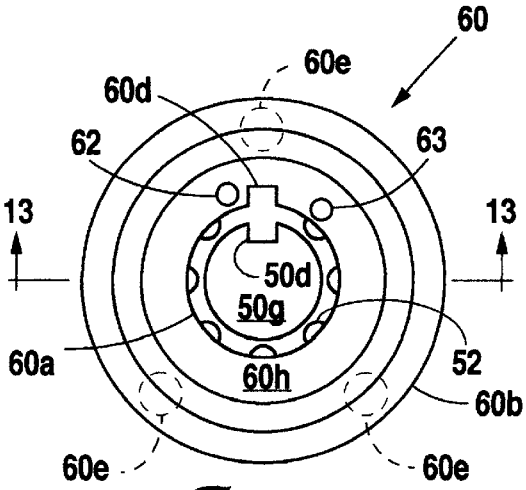
FIG. 12 is a front elevational view of the lock of FIG. 10.
Figure 13:
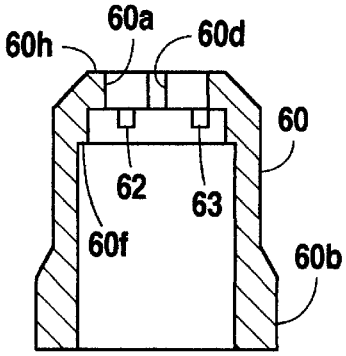
FIG. 13 is a sectional view of the lock housing of FIG. 10.

When rifle sighting apparatus 100 is assembled, spring keeper cylinder 40 abuts face 30*b* of mounting plate 30, portion 50*a* of lock shaft 50 extends through hole 30*a* of mounting plate 30, portion 50*e* of lock shaft 50 resides inside hole 40*a* of spring keeper cylinder 40, and base 60*b* of lock housing 60 abuts face 30*b* of mounting plate 30. Lock housing 60 is secured to mounting plate 30 by inserting screws 32 through holes 30*e* and into tapped holes 60*e* (shown in FIG. 12) in base 60*b* of lock housing 60. Edge 50*f* of lock pin 50 abuts ridge 60*f* (shown in FIG. 13) of lock housing 60. Cam 26 is fastened to lock shaft 50 by installing screw 24 into a tapped hole (not shown) in the end of portion 50*a*. Set screw 64 engages outer surface 40*d* of spring keeper cylinder 40 and thereby immobilizes spring keeper cylinder 40. But for the action of locking pins 44 as described below, lock shaft 50 is rotatable with respect to spring keeper cylinder 40. In the locked position, groove 50*d* of lock shaft 50 is aligned with slot 60*d* of lock housing 60, as shown in FIG. 12, and pin springs 42 cause locking pins 44 to protrude slightly into holes 50*b* of lock shaft 50, which prevents lock shaft 50 from rotating. Cam 26, which is fastened to lock shaft 50, is positioned adjacent the rifle trigger (not shown) in the unfired position as discussed above in connection with FIGS. 3–6. Push pins 52, which abut locking pins 44 inside holes 50*b* of lock shaft 50, protrude outwardly from holes 50*b* in varying amounts because of their varying lengths. As illustrated in FIG. 12, push pins 52 are partially visible through the annulus formed between portion 50*g* of lock shaft 50 and the edge of hole 60*a* in lock housing 60. Referring to FIGS. 12 and 13, surface 50*g* of lock shaft 50 is generally flush with surface 60*h* of lock housing 60.

Figure 11:
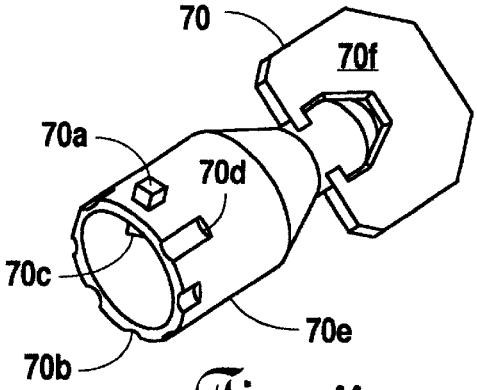
FIG. 11 is a perspective view of the key of FIG. 10 as viewed from the opposite direction as FIG. 10.

To rotate lock shaft 50 and thereby rotate cam 26 into engagement with the rifle trigger in order to fire the rifle, a proper key 70 is required. As shown in FIGS. 10 and 11, key 70 has a handle 70*f* attached to a key cylinder 70*e*. Key cylinder 70*e* has a plurality of recesses 70*b* formed in its outer surface at its leading edge, and recesses 70*b* are bounded by shoulders 70*d*. The lengths of recesses 70*b* are respectively selected to mate with push pins 52. An inner nub 70*c* protrudes inwardly from key cylinder 70*e*, and an outer nub 70*a* protrudes outwardly from key cylinder 70*e*. To insert key 70 into lock housing 60, nubs 70*a* and 70*c* are aligned with slot 60*d* and groove 50*d*, respectively, and key cylinder 70*e* is inserted through hole 60*a* and over portion 50*g* of lock shaft 50. As key 70 is inserted, shoulders 70*d* eventually engage push pins 52, which abut locking pins 44, which in turn are biased toward push pins 52 by pin springs 42. Upon further insertion of key 70, shoulders 70*d* depress push pins 52 which in turn depress locking pins 44 by compressing pin springs 42. Edge 50*c* of lock shaft 50 abuts edge 40*c* of spring keeper cylinder 40 to form a shear plane. If recesses 70*b* properly match push pins 52, the interfaces of push pins 52 with locking pins 44 eventually will simultaneously arrive at the shear plane. At that point, locking pins 44 are no longer protruding into holes 50*b*, and lock shaft 50 is then free to rotate relative to spring keeper cylinder 40, except as limited by stop pins 62 and 63 which engage outer nub 70*a* of key 70. As key 70 is rotated, inner nub 70*c* of key 70 engages groove 50*d* of lock shaft 50 and thereby rotates lock shaft 50, which in turn rotates cam 26 into engagement with the rifle trigger to depress the trigger to the firing position. In the embodiment shown in FIG. 12, which is designed for clockwise rotation of lock shaft 50, stop pin 62 prevents counterclockwise rotation of key 70, and stop pin 63 limits the degree of clockwise rotation to that which is necessary to rotate cam 26 sufficiently to depress the rifle trigger to the firing position. Stop pins 62 and 63 could be placed in different locations to allow counterclockwise rotation or a different degree of rotation, whether clockwise or counterclockwise, depending on the particular cam design and the desired direction of rotation. As with the other embodiments discussed above, sighting apparatus 100 substantially eliminates jerking of the trigger because any speed of manual rotation of key 70 results in a smooth rearward displacement of the trigger.

Figure 14:
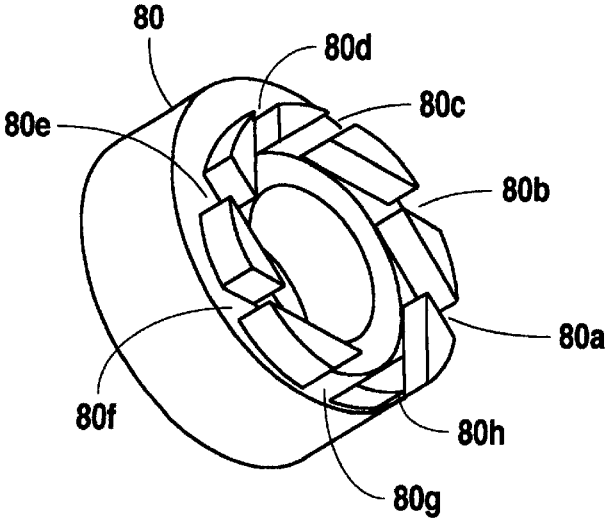
FIG. 14 is a perspective view of an alternative cam in accordance with the present invention.

The lock and key apparatus described above and illustrated in FIGS. 10–13 is preferably made from a conventional cam lock such as those available from Fort Lock Corp., 3000 N. River Rd., River Grove, Ill. 60171. However, persons skilled in the art will recognize that other suitable locks and keys may also be used, with the objective being to provide a device to which the cam may be attached that will not rotate unless actuated with a proper key. It will also be apparent that the lock and key apparatus could be installed on either side of the rifle, as desired, for either a right-handed user or a left-handed user. Additionally, it will be apparent to those skilled in the art that the cam may have any desired number of slots for receiving end 28*a* of spring 28 in order to provide the desired amount of torsional resistance and degree of cam rotation required to fire the rifle, depending on the particular trigger configuration and the preference of the user. For example, FIG. 14 illustrates a cam 80 having eight slots 80*a* through 80*h*. In cooperation with slots 30*c* and 30*d* on mounting plate 30, slots 80*a* through 80*h* provide sixteen different positions for cam 80. Similarly, mounting plate 30 may have any desirable number of slots for receiving end 28*b* of spring 28 to increase the adjustability of the cam. The same is true for the other embodiments disclosed herein.

Figure 15:
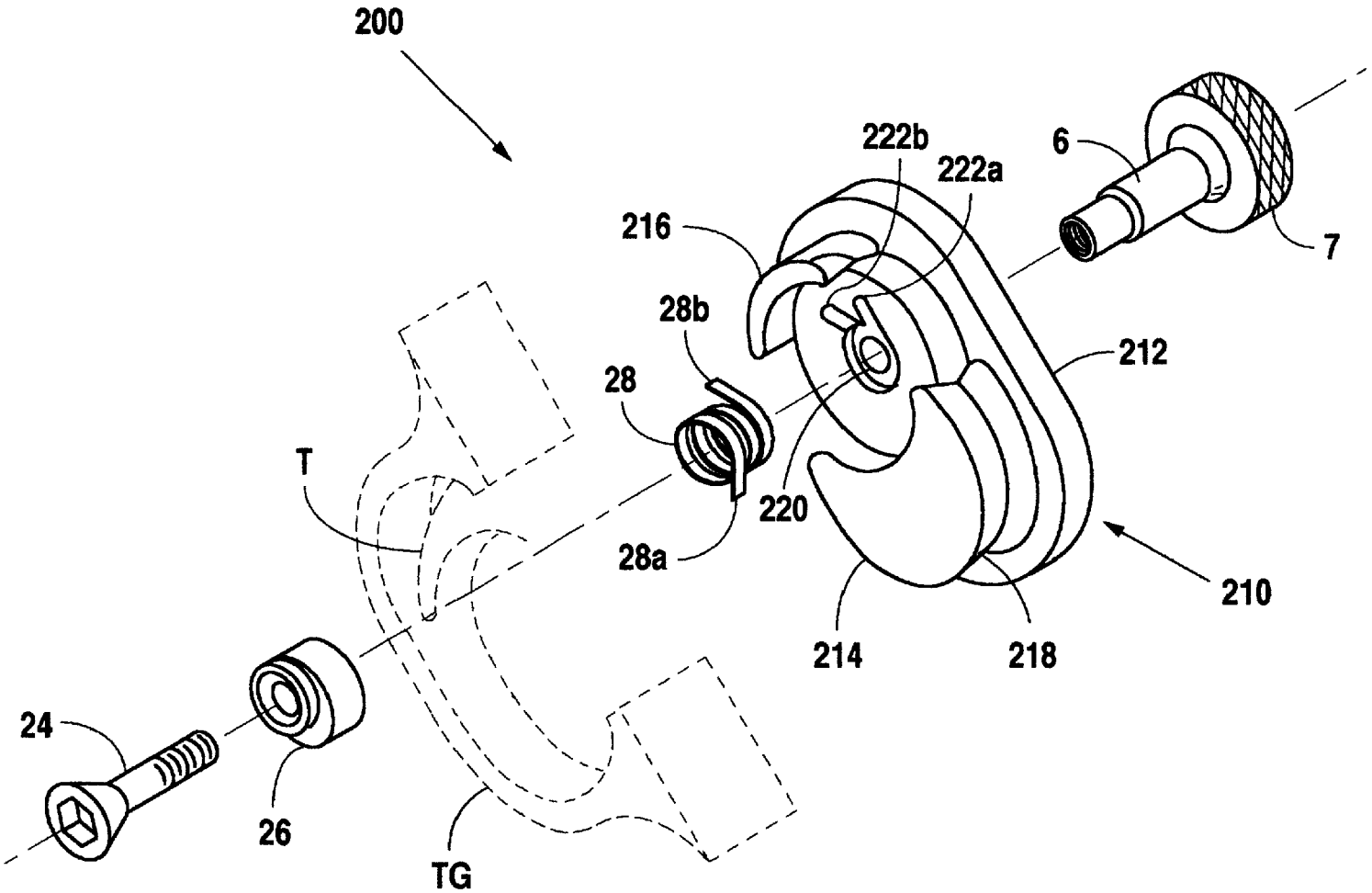
FIG. 15 is an exploded perspective view illustrating yet another alternative embodiment of the present invention.

FIG. 15 illustrates yet another embodiment 200 of this invention. Rather than a pair of plates for engaging the sides of the trigger guard TG, embodiment 200 comprises a mounting body 210 that is adapted for insertion into trigger guard TG. Mounting body 210 comprises a generally planar mounting plate 212 from which one or more plug portions 214 and 216 extend. Plug portions 214 and 216, which are preferably made from a resilient material, are shaped to mate with the interior surface of trigger guard TG and are preferably slightly larger than the opening of trigger guard TG such that the edges 218 of plug portions 214 and 216 snugly engage the interior surface of trigger guard TG. Edges 218 of plug portions 214 and 216 may be beveled to help hold mounting body 210 in place. Mounting body 210 has a hole 220 for mounting a trigger actuating shaft 6, the outer end of which preferably has a manually operable knob 7. The inwardly projecting end of actuating shaft 6 mounts a cam 26 with screw 24 which screws into a tapped hole in the inwardly projecting end of shaft 6. Spring 28 is mounted on shaft 6 between cam 26 and mounting body 210, which has one or more slots 222*a* and 222*b* adjacent hole 220 for receiving end 28*b* of spring 28. End 28*a* of spring 28 engages a slot on cam 26 as discussed above in connection with FIGS. 5–9. When installed, cam 26 is positioned closely adjacent trigger T in its inactive or nonfiring (neutral) position. As discussed above, rotation of shaft 6 using knob 7 causes cam 26 to effect a gradual rearward displacement of trigger T to its firing position. Once again, this embodiment substantially eliminates jerking of trigger T because any speed of manual rotation of knob 7 still results in a smooth rearward displacement of trigger T. Of course, embodiment 200 may be made for either a right-handed or a left-handed user.

Figure 16:
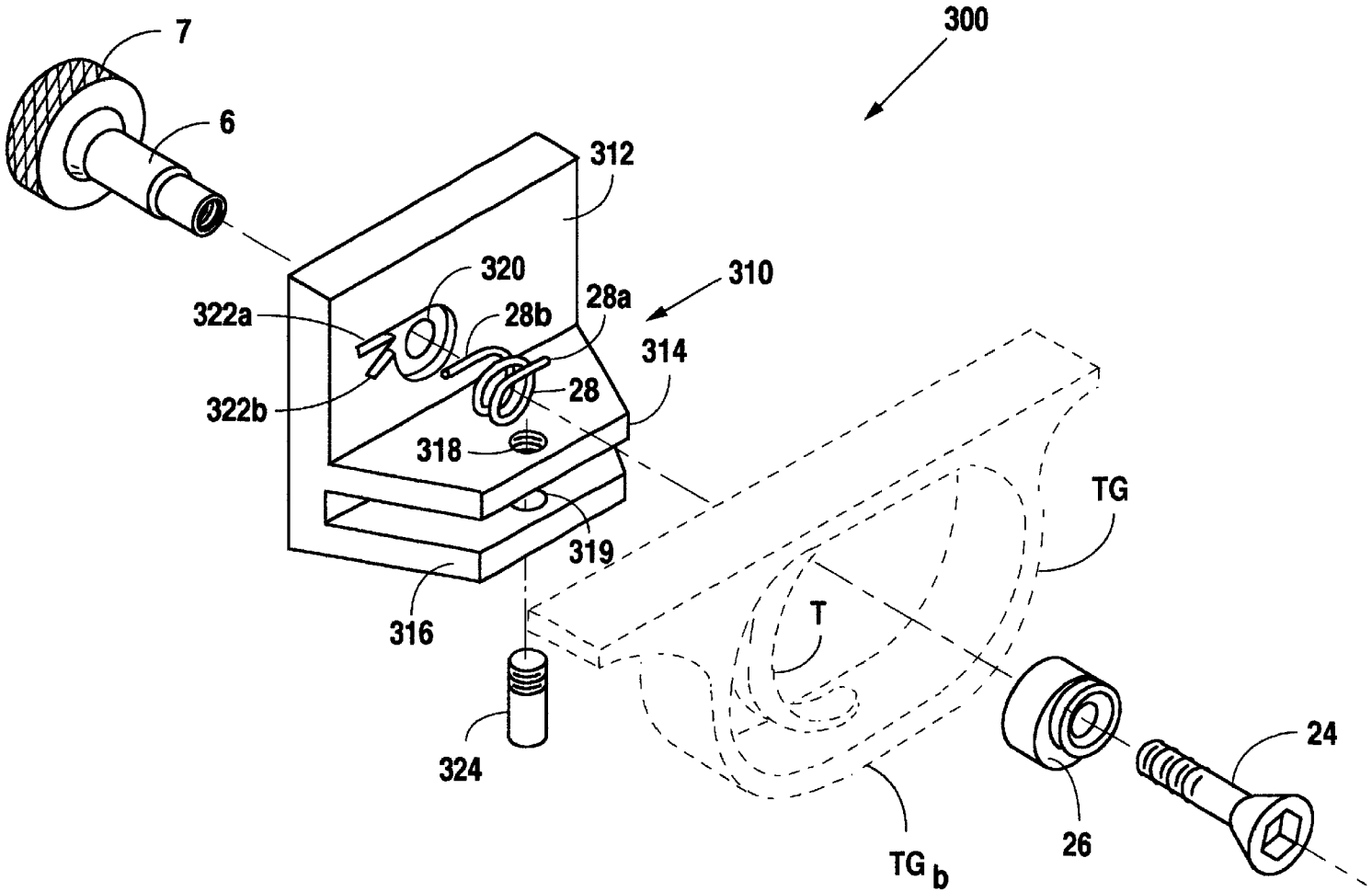
FIG. 16 is an exploded perspective view illustrating still another alternative embodiment of the present invention.

FIG. 16 illustrates still another embodiment 300 of this invention which clamps to the trigger guard TG. Clamp 310 comprises a mounting plate 312 having a hole 320 for rotatably mounting a trigger actuating shaft 6, which preferably has a knob 7 on its outer end. Clamp 310 preferably has a pair of clamping plates 314 and 316 for sandwiching the bottom portion $TG_b$ of trigger guard TG. Clamp 310 is preferably installed on the bottom portion $TG_b$ of trigger guard TG because that portion is generally planar. However, clamp 310 may be provided with suitable clamping plates that are specially adapted for clamping to other portions of trigger guard TG, if desired. Alternatively, one or more holes may be drilled and tapped in trigger guard TG and a single clamping plate with matching holes may be secured to trigger guard TG with one or more screws. After clamping plates 314 and 316 are installed on a suitable portion of trigger guard TG, a screw 324 is installed into holes 318 and 319 of clamping plates 314 and 316 to securely fasten clamp 310 to trigger guard TG. Spring 28 and cam 26 are installed on shaft 6 using screw 24. Mounting plate 312 has one or more slots 322*a* and 322*b* adjacent hole 320 for receiving end 28*b* of spring 28. End 28*a* of spring 28 engages a slot on cam 26 as discussed above in connection with FIGS. 5–9. As with other embodiments discussed above, cam 26 is positioned closely adjacent trigger T in the neutral position. As discussed above, rotation of shaft 6 using knob 7 causes cam 26 to effect a gradual rearward displacement of trigger T to its firing position. Once again, this device substantially eliminates jerking of trigger T because any speed of manual rotation of knob 7 still results in a smooth rearward displacement of trigger T. Embodiment 300 may be made for either a right-handed or a left-handed user.

Although the foregoing specific details describe preferred embodiments of this invention, persons reasonably skilled in the art will recognize that various changes may be made in the details of the apparatus of this invention without departing from the spirit and scope of the invention as defined in the appended claims. Therefore, it should be understood that this invention is not to be limited to the specific details shown and described herein.

I claim:

1. An apparatus for operating the trigger of a rifle for sighting in purposes, said rifle having a trigger and a trigger guard, said trigger having a nonfiring position and a firing position, said apparatus comprising:

a mounting plate securable to said trigger guard, said mounting plate having an outer side and an inner side;

a shaft rotatably mounted in said mounting plate, said shaft having a first portion disposed on said outer side of said mounting plate and a second portion disposed on said inner side of said mounting plate;

a cam secured to said second portion of said shaft; and a resilient rotation limiter for opposing and limiting the rotation of said shaft, said rotation limiter having a neutral position in which said cam is positionable adjacent said trigger in said nonfiring position;

wherein, when said apparatus is secured to said trigger guard, application of a sufficient torque to said shaft will produce rotation of said shaft sufficient to cause said cam to depress said trigger to said firing position, and said rotation limiter will return to said neutral position upon release of said torque.

2. The apparatus of claim 1 wherein said rotation limiter comprises a helical spring.

3. The apparatus of claim 2 wherein said helical spring has a first end with a first prong and a second end with a second prong, said mounting plate has at least one slot with said first prong of said spring disposed therein, and said cam has at least one slot with said second prong of said spring disposed therein.

4. The apparatus of claim 3 wherein said mounting plate has a plurality of slots for selectively receiving said first prong of said spring.

5. The apparatus of claim 3 wherein said cam has a plurality of slots for selectively receiving said second prong of said spring.

6. The apparatus of claim 1 further comprising a manually graspable knob on said first portion of said shaft.

7. The apparatus of claim 1 wherein said rotation limiter will limit said rotation of said shaft substantially to that which is required to move said trigger to said firing position.

8. The apparatus of claim 1 further comprising an opposing plate and at least one fastener connecting said mounting plate to said opposing plate, wherein said mounting plate and said opposing plate respectively abut opposite sides of said trigger guard.

9. The apparatus of claim 1 further comprising at least one plug portion depending from said mounting plate, wherein said at least one plug portion may be pressed into said trigger guard to secure said apparatus to said trigger guard.

10. The apparatus of claim 1 further comprising at least one clamping plate depending from said mounting plate and at least one fastener for securing said at least one clamping plate to said trigger guard.

11. The apparatus of claim 1 further comprising a lock mechanism in cooperation with said shaft, wherein a proper key is required to rotate said shaft in order to fire said rifle.

12. The apparatus of claim 11 wherein said lock mechanism comprises a cam lock.

13. An apparatus for operating the trigger of a rifle for sighting in purposes, said rifle having a trigger and a trigger guard, said trigger having a nonfiring position and a firing position, said apparatus comprising:

a mounting plate having an outer side and an inner side, said inner side having a first plurality of slots for selectively receiving an end of a spring;

an opposing plate;

at least one fastener for connecting said mounting plate to said opposing plate such that said mounting plate and said opposing plate respectively abut opposite sides of said trigger guard with said inner side of said mounting plate facing the interior of said trigger guard;

a shaft rotatably mounted in said mounting plate, said shaft having a first portion with a manually graspable knob disposed on said outer side of said mounting plate and a second portion disposed on said inner side of said mounting plate;

a cam secured to said second portion of said shaft, said cam having a second plurality of slots for selectively receiving an end of a spring; and a helical spring for opposing and limiting the rotation of said shaft, said spring having a neutral position in which said cam is positionable adjacent said trigger in said nonfiring position, said spring having a first end disposed in one of said first plurality of slots and a second end disposed in one of said second plurality of slots;

wherein, when said apparatus is secured to said trigger guard, application of a sufficient torque to said knob will produce rotation of said shaft sufficient to cause said cam to depress said trigger to said firing position, and said spring will return to said neutral position upon release of said torque.

14. The apparatus of claim 13 wherein said mounting plate may be installed on either side of said trigger guard.

15. An apparatus for operating the trigger of a rifle for sighting in purposes, said rifle having a trigger and a trigger guard, said trigger having a nonfiring position and a firing position, said apparatus comprising:

a mounting plate having an outer side and an inner side, said inner side having a first plurality of slots for selectively receiving an end of a spring;

an opposing plate;

at least one fastener for connecting said mounting plate to said opposing plate such that said mounting plate and said opposing plate respectively abut opposite sides of said trigger guard with said inner side of said mounting plate facing the interior of said trigger guard;

a shaft rotatably mounted in said mounting plate, said shaft having a first portion disposed on said outer side of said mounting plate and a second portion disposed on said inner side of said mounting plate;

a cam lock disposed on said outer side of said mounting plate in cooperation with said first portion of said shaft, said lock preventing rotation of said shaft until insertion of a proper key into said lock;

a cam secured to said second portion of said shaft, said cam having a second plurality of slots for selectively receiving an end of a spring; and a helical spring for opposing and limiting the rotation of said shaft, said spring having a neutral position in which said cam is positionable adjacent said trigger in said nonfiring position, said spring having a first end disposed in one of said first plurality of slots and a second end disposed in one of said second plurality of slots;

wherein, when said apparatus is secured to said trigger guard and a proper key is inserted into said lock, application of a sufficient torque to said key will produce rotation of said shaft sufficient to cause said cam to depress said trigger to said firing position, and said spring will return to said neutral position upon release of said torque.

16. The apparatus of claim 15 wherein said cam lock comprises at least one stop pin that limits the rotation of said key.

17. An apparatus for operating the trigger of a rifle for sighting in purposes, said rifle having a trigger and a trigger guard, said trigger having a nonfiring position and a firing position, said apparatus comprising:

a mounting plate having an outer side and an inner side, said inner side having a first plurality of slots for selectively receiving an end of a spring, said mounting plate having at least one plug portion depending from said inner side, wherein said at least one plug portion may be pressed into said trigger guard to secure said apparatus to said trigger guard;

a shaft rotatably mounted in said mounting plate, said shaft having a first portion with a manually graspable knob disposed on said outer side of said mounting plate and a second portion disposed on said inner side of said mounting plate;

a cam secured to said second portion of said shaft, said cam having a second plurality of slots for selectively receiving an end of a spring; and a helical spring for opposing and limiting the rotation of said shaft, said spring having a neutral position in which said cam is positionable adjacent said trigger in said nonfiring position, said spring having a first end disposed in one of said first plurality of slots and a second end disposed in one of said second plurality of slots;

wherein, when said at least one plug portion is pressed into said trigger guard, application of a sufficient torque to said knob will produce rotation of said shaft sufficient to cause said cam to depress said trigger to said firing position, and said spring will return to said neutral position upon release of said torque.

18. An apparatus for operating the trigger of a rifle for sighting in purposes, said rifle having a trigger and a trigger guard, said trigger having a nonfiring position and a firing position, said apparatus comprising:

a mounting plate having an outer side and an inner side, said inner side having a first plurality of slots for selectively receiving an end of a spring, said mounting plate having a pair of clamping plates depending from said inner side, said clamping plates being adapted to fit over a portion of said trigger guard;

at least one fastener for fastening said clamping plates to said trigger guard;

a shaft rotatably mounted in said mounting plate, said shaft having a first portion with a manually graspable knob disposed on said outer side of said mounting plate and a second portion disposed on said inner side of said mounting plate;

a cam secured to said second portion of said shaft, said cam having a second plurality of slots for selectively receiving an end of a spring; and a helical spring for opposing and limiting the rotation of said shaft, said spring having a neutral position in which said cam is positionable adjacent said trigger in said nonfiring position, said spring having a first end disposed in one of said first plurality of slots and a second end disposed in one of said second plurality of slots;

wherein, when said clamping plates are fastened to said trigger guard, application of a sufficient torque to said knob will produce rotation of said shaft sufficient to cause said cam to depress said trigger to said firing position, and said spring will return to said neutral position upon release of said torque.

19. A method of operating the trigger of a rifle for sighting in purposes, said rifle having a trigger and a trigger guard, said trigger having a nonfiring position and a firing position, said method comprising the steps of:

securing a mounting plate to said trigger guard;

mounting a rotatable shaft in said mounting plate;

securing a cam to said shaft;

installing a resilient rotation limiter in cooperation with said mounting plate and said cam such that, when said rotation limiter is in its neutral position, said cam is positioned adjacent said trigger in said nonfiring position;

applying a torque to said shaft sufficient to cause said cam to depress said trigger to said firing position; and removing said torque to allow said rotation limiter to return to said neutral position.

* * * * *